United States Patent [19]

Donarumma et al.

[11] 4,443,481

[45] Apr. 17, 1984

[54] COFFEE INFUSION CONTAINER

[76] Inventors: Angelo Donarumma; Thomas Callahan, both of 9 Longworth Ave., Dix Hills, N.Y. 11746

[21] Appl. No.: 432,787

[22] Filed: Feb. 14, 1983

[51] Int. Cl.[3] ..... B65B 29/04

[52] U.S. Cl. ..... 426/82; 99/295; 99/304; 206/0.5; 426/77

[58] Field of Search ..... 426/82, 80, 83, 77, 426/84, 81, 78, 79; 206/0.5; 99/295, 323, 322, 304; 210/470, 497.01, 497.3

[56] References Cited

U.S. PATENT DOCUMENTS

| | | | |
|---|---|---|---|
| 31,910 | 4/1861 | Sanborn | 99/304 |
| 103,946 | 6/1870 | Wakeman et al. | 99/323 |
| 489,468 | 1/1893 | Dillingham | 426/82 |
| 960,353 | 6/1910 | Leimbach et al. | 99/323 |
| 1,127,780 | 2/1915 | Konar | 99/323 |
| 1,572,861 | 2/1926 | Larrey | 99/323 |
| 1,775,347 | 9/1930 | Hirschorn | 426/81 |
| 2,123,054 | 7/1938 | Lamb et al. | 426/80 |
| 2,133,166 | 10/1938 | Fritsche | 99/323 |
| 3,083,100 | 3/1963 | Baran | 99/295 |
| 3,193,388 | 7/1965 | Conrey | 426/80 |
| 3,361,052 | 1/1968 | Weber | 99/304 |
| 3,384,492 | 5/1968 | Spencer | 426/80 |
| 3,483,812 | 12/1969 | Gast et al. | 99/295 |
| 3,607,302 | 9/1971 | Beck | 426/80 |
| 3,767,420 | 10/1973 | Kim | 426/77 |
| 3,800,690 | 4/1974 | Molenaar et al. | 426/82 |
| 3,833,740 | 9/1974 | Schmidt | 426/80 |
| 3,935,318 | 1/1976 | Mihalide | 426/80 |
| 4,211,156 | 7/1980 | Zimmermann | 426/80 |
| 4,278,691 | 7/1981 | Donarumma et al. | 426/80 |

FOREIGN PATENT DOCUMENTS

| | | | |
|---|---|---|---|
| 124465 | 10/1945 | Australia | 99/322 |
| 224812 | 1/1959 | Australia | 99/322 |
| 412097 | 6/1934 | United Kingdom | 99/323 |
| 854867 | 11/1960 | United Kingdom | 99/323 |

*Primary Examiner*—Steven L. Weinstein
*Attorney, Agent, or Firm*—Michael I. Kroll

[57] ABSTRACT

A coffee infusion container is provided consisting of a porous cone shaped inner section that is inverted to accept hot water and the outer shape of the enclosure is shaped in the form of a partial cone with the upper most section removed and a rod shaped handle is provided and affixed to said container so that the container retains its shape after being subjected to hot water with the container being dunked into a hot cup of hot water so the a cup of coffee may be brewed.

3 Claims, 7 Drawing Figures

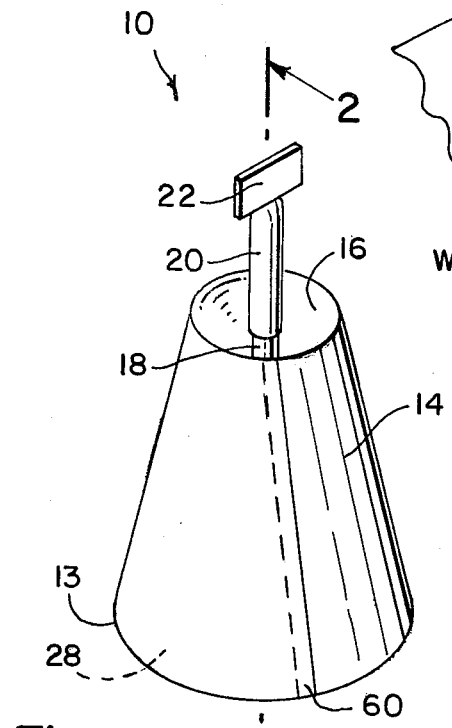
Figure 1
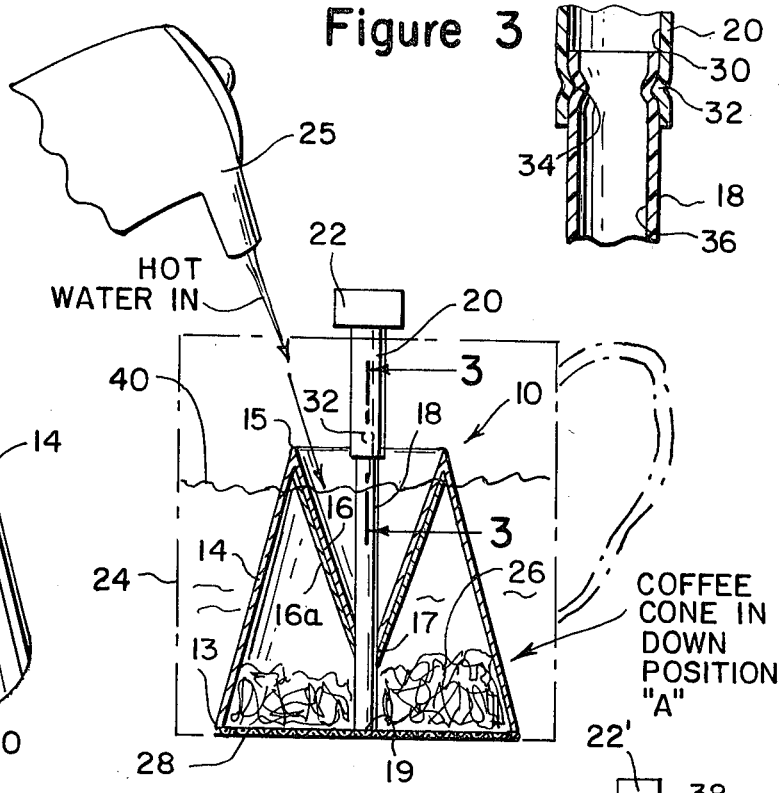
Figure 2
Figure 3
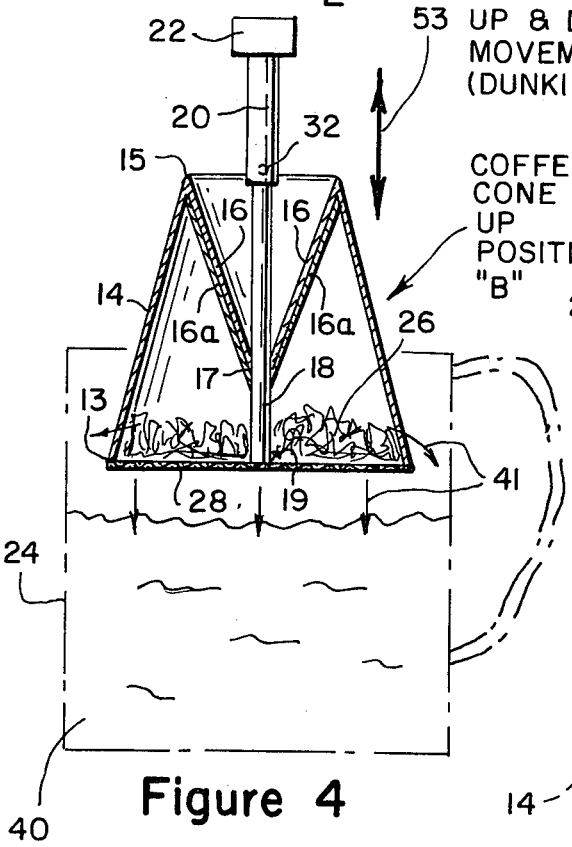
Figure 4
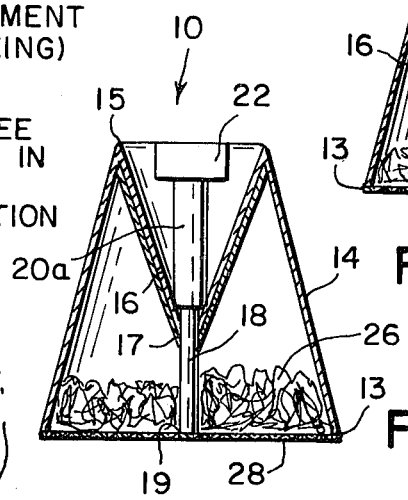
Figure 5
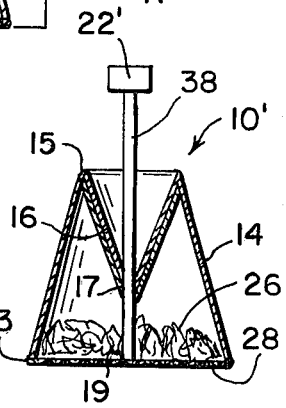
Figure 7
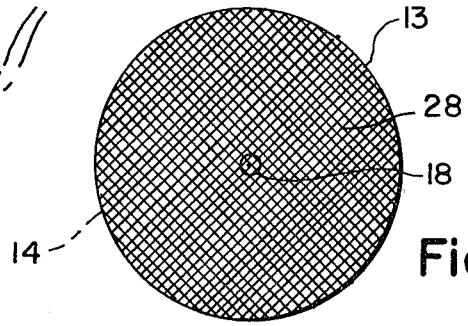
Figure 6

COFFEE INFUSION CONTAINER

BACKGROUND OF THE INVENTION

1. Field of Invention

The instant invention relates generally to a device for brewing coffee and specifically the instant invention relates to a device whereby an individual cup of coffee may be brewed.

2. Description of Prior Art

The prior art consists of a variety of means whereby coffee may be brewed for a single cup said devices referred to as coffee infusion bags.

The disadvantages of said devices are numerous, the main disadvantage being that the prior art infusion bags are not practical to use as they either float to the surface or are non rigid so that they do not maintain their shape when hot water is introduced and when they loose their shape they also loose their ability to function as a coffee infusion bag. Said devices simply become a wet soggy mass and loose their function as a coffee infusion bag.

SUMMARY OF THE INVENTION

The instant invention overcomes the disadvantages of the prior art by providing a rigid receptable for both the coffee grinds and the hot water that is used to brew the coffee.

A porous container is provided to hold the coffee grinds said container being rigid enough so that it has substantial wet strength, that is, it will maintain its shape after hot water is introduced to it.

Said container is provided with a handle so that it may be dunked into a cup of hot water as many times is necessary in order for a cup of brewed coffee to be made. Said handle is fastened to the bottom of the invention and to the center section so that the invention will retain its wet strength as required.

Accordingly it is an object of the instant invention to provide a coffee infusion bag that is functional and will not loose its shape when hot water is introduced.

It is a further object of the instant invention to provide a low cost coffee infusion bag so that the user may vary the strength of brewed coffee.

BRIEF DESCRIPTION OF THE DRAWING FIGURES

FIG. 1 of the drawing shows a perspective view of the coffee infusion bag.

FIG. 2 of the drawing shows a cross section of the coffee infusion bag with hot water being poured into said coffee infusion bag.

FIG. 3 of the drawing shows a cross section of the coffee infusion handle.

FIG. 4 of the drawing shows the coffee infusion bag after water has been introduced to it in the withdrawn position.

FIG. 5 of the drawing shows the coffee infusion bag with its handle in the collapsed position.

FIG. 6 of the drawing shows the bottom of the coffee infusion bag.

FIG. 7 of the drawing shows a single piece handle.

DESCRIPTION OF THE PREFERRED EMBODIMENTS

Referring descriptively to the drawings in which similar reference characters denote similar elements throughout the several views, the drawing illustrates the instant invention generally specified as 10.

A partial cone shaped segment 14 is provided containing a seam 60 said cone shaped segment 14 being constructed typically from porous 10 pound tea paper. The bottom of said cone shsaped segment 14 is closed off by rigid porous member 28 so that coffee grinds will not escape through the openings in said rigid porous member 28.

An inside funnel portion 16 is provided in the shape of an inverted cone said inside funnel portion 16 also constructed typically from porous 10 pound tea paper with said funnel portion 16 having a rigid porous member **16*a* provided for strength so that when funnel portion 16** gets wet it retains its shape.

Cone shaped segment 14 and funnel portion 16 may be constructed from a single piece of tea paper or a seam 15 may be employed.

A handle is provided so that when the instant invention has hot water introduced to it said invention will retain its shape and the handle also permits the instant invention to be dunked into and out of a cup of hot water, said handle having a bottom stem 18 affixed at one end to rigid porous member 28 and along the length of bottom stem 18 is affixed the apex of funnel portion 16 and rigid porous member **16*a* at seal 17 so that the entire assembly will retain its shape when hot water is introduced to it. The other end of bottom stem 18 has attached to it top stem 20 and top stem 20 having aperture 30 and depression 32 so that said top stem 20 is held firmly to bottom stem 18 by depression 34 in bottom stem 18, said top stem 20 and bottom stem 18 collapsing into one another, so that in the folded position the handle is contained within the confines of funnel portion 16. A cross bar 22 is provided at the top end of top stem 20 so that a person may safely grasp the invention while hot water is poured into the center section of funnel portion 16**.

Said invention may be provided with a fixed stem 38 and cross bar 22' as shown in FIG. 7 with the invention generally depicted as 10'.

Rigid porous member 28 is sealed at 13 to the partial cone shaped segment 14 at the bottom periphery of cone shaped section 14 so that an enclosure results therefrom said attachment at 13 being such that coffee grinds may not escape out of the aforesaid enclosure.

Coffee grinds 26 is inserted into the aforementioned enclosure prior to the enclosure being sealed with cup 24 provided as a means to contain the brewed coffee.

As hot water is introduced into the invention by pot 25 the hot water is directed into the enclosure of the invention by inverted cone 16 and by dunking action the instant invention will retain the coffee grinds within its envelope and permit hot water to mix with the coffee grinds to produce a cup of brewed coffee.

The construction of the aforementioned invention is rigid, that is it will not collapse when it is wet said invention maintaining its shape during repeated dunkings.

While the form of apparatus herein described constitutes a preferred embodiment of the invention, it is understood that the invention is not limited to this precise form of apparatus and that changes may be made therein without departing from the scope of this invention.

Having regard to the foregoing disclosure, the following is claimed as the inventive and patentable embodiments thereof:

1. An infusion container of the type wherein a porous enclosure contains a substance to be dissolved in a liquid, wherein the improvement comprises:

(a) an enclosure having an exterior shape in the form of a truncated cone the upper most section being removed and, connected to the uppermost section of said truncated cone, a center section which extends down toward a base connected to the lowermost portion of said truncated cone, said center section being shaped relative to said truncated cone in the form of an inverted cone; the enclosure containing and retaining said substance being defined by said truncated cone, said inverted cone, and said base, all of which are porous (b) a rod shaped handle with one end of said handle rigidly fixed to said base of said enclosure and with the lowermost and most tapered portion of the center section inverted cone affixed to the rod handle along the length of said rod shaped handle spaced from said one end, and with the end of said handle opposite said one end projecting outside the enclosure so that the user may hold the enclosure while a hot liquid is poured into the middle section of said inverted cone said rod shaped handle giving rigidity to the enclosure so that the enclosure retains its shape when dunked into the liquid; said base comprising a rigid porous member, said truncated cone comprising filter paper, and said inverted cone comprising a dual layer of filter paper and a rigid porous member.

2. An infusion container as recited in claim 1 wherein the rod shaped handle is collapsible.

3. An infusion container as recited in claim 1 wherein the substance to be dissolved is coffee.

* * * * *